US006520434B1

(12) United States Patent
Reiter

(10) Patent No.: US 6,520,434 B1
(45) Date of Patent: Feb. 18, 2003

(54) FUEL INJECTION VALVE

(75) Inventor: Ferdinand Reiter, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/763,346

(22) PCT Filed: Dec. 2, 1999

(86) PCT No.: PCT/DE99/03868

§ 371 (c)(1),
(2), (4) Date: Apr. 11, 2001

(87) PCT Pub. No.: WO00/79120

PCT Pub. Date: Dec. 28, 2000

(30) Foreign Application Priority Data

Jun. 18, 1999 (DE) ..... 199 27 900

(51) Int. Cl.[7] ..... F02M 51/00

(52) U.S. Cl. ..... 239/585.5; 239/533.3; 239/533.9; 239/533.11; 239/585.1; 239/585.2; 239/585.3; 239/585.4; 251/129.19; 251/129.21

(58) Field of Search ..... 239/533.3, 533.9, 239/533.11, 585.1, 585.2, 585.3, 585.4, 585.5; 251/129.21, 129.12, 129.13, 129.19

(56) References Cited

U.S. PATENT DOCUMENTS

| | | | | | |
|---|---|---|---|---|---|
| 4,766,405 | A | | 8/1988 | Daly et al. | |
| 5,114,077 | A | | 5/1992 | Cerny | |
| 5,203,538 | A | | 4/1993 | Matsunaga et al. | |
| 5,236,173 | A | | 8/1993 | Wakeman | |
| 5,299,776 | A | | 4/1994 | Brinn, Jr. et al. | |
| 5,645,226 | A | * | 7/1997 | Bright | 239/585.1 |
| 5,716,010 | A | * | 2/1998 | Tada et al. | 239/585.1 |
| 6,142,395 | A | * | 11/2000 | Reiter | 239/585.1 |
| 6,367,769 | B1 | * | 4/2002 | Reiter | 239/585.5 |

* cited by examiner

*Primary Examiner*—Robin O. Evans
(74) *Attorney, Agent, or Firm*—Kenyon & Kenyon

(57) ABSTRACT

A fuel injector valve for fuel injection systems of internal combustion engines has a magnetic coil, an armature to which the magnetic coil applies a force against a resetting spring in the lifting direction, and a valve needle connected to a valve closing member. The armature is able to move between a first stop connected to the valve needle and limiting the movement of the armature in the lifting direction and a second stop connected to the valve needle and limiting the movement of the armature against the lifting direction. The second stop is formed by a spring element.

8 Claims, 3 Drawing Sheets

FUEL INJECTION VALVE

FIELD OF THE INVENTION

The present invention related to a fuel injector valve.

BACKGROUND INFORMATION

A fuel injector valve is described in U.S. Pat. No. 5,299,776. The fuel injector valve has a valve closing member that is connected to a valve needle and interacts with a valve seat surface provided on a valve seat body to form a sealed seat. A magnetic coil, which interacts with a magnetic armature that moves on the valve needle between a first stop limiting the armature movement in the lifting direction of the valve needle and a second stop limiting the armature movement against the lifting direction, is provided for the electromagnetic operation of the fuel injector valve. Within certain limits, the axial armature clearance defined between the two stops isolates the inert mass of the valve needle and the valve closing member from the inert mass of the armature on the other. This counteracts a rebounding of the valve closing member from the valve seat surface within certain limits when the fuel injector valve closes. Bounce pulses of the valve needle and valve closing member cause the fuel injector valve to open briefly in an uncontrolled manner, making it impossible to reproduce the metered amount of fuel and resulting in uncontrolled injection. However, since the axial position of the armature in relation to the valve needle is completely undefined due to the free movement of the armature in relation to the valve needle, bounce pulses can be avoided only to a limited extent. In particular, it is not possible to prevent the armature from striking the stop which faces the valve closing member while the fuel injector valve closes, abruptly transmitting its pulse to the valve needle and thus also to the valve closing member.

To dampen the force of the armature striking the stop facing the valve closing member, a method is described in U.S. Pat. No. 4,766,405, in which a damping member made of an elastomeric material, such as rubber, is placed between the armature and the stop. Elastomeric materials have the disadvantage that their damping performance is highly dependent on temperature, and the damping effect decreases as the temperature rises. In addition, elastomeric materials have a limited long-term stability, particularly when they come into contact with the fuel to be injected. Furthermore, mounting a damping plate made of an elastomeric material is complicated. In addition, it is not possible to selectively adjust the damping characteristics.

The provision of a damping spring in the form of a cup spring between the valve seat body and a valve seat carrier, on which the valve seat body is mounted, thereby causing the valve closing member to come to rest gently against the valve seat surface provided on the valve seat body, is described in U.S. Pat. No. 5,236,173. However, this damping method has the disadvantage that the valve seat body swings back in the direction of injection after the valve closing member strikes the valve seat body, while the valve closing member either remains stationary or even moves away from the valve seat body against the direction of injection as a result of pulse reversal. Valve bounce pulses can therefore occur with even greater intensity in this fuel injector valve design.

SUMMARY OF THE INVENTION

The fuel injector valve according to the present invention has the advantage that it can help avoid possible bounce pulses of the valve needle even more effectively. The result is high long-term stability, since the spring element has a longer service life than does an elastomeric material and, in particular, cannot be destroyed when exposed to fuel. It is also possible to selectively adjust the damping characteristics insofar as certain materials, shapes, and pre-tensions can be used for the spring element.

The spring element is used firstly as a lower second stop for the armature; secondly as a damping element that continuously brakes armature movement and thus prevents or greatly limits valve needle bouncing against the valve seat surface; and thirdly as a sliding spring that presses the armature, in its idle position, until it comes to rest on the first stop. With this single spring element component, a very high functional integration can advantageously be achieved.

The spring element according to the present invention can be advantageously produced easily and economically, as well as mounted and adjusted on the valve needle in the fuel injector valve.

The features described in the subclaims provide advantageous embodiments and refinements of the fuel injector valve specified in the main claim.

It is advantageous to design the spring element with a shank and multiple spring arms extended outward from the shank. It is possible to use a spring steel sheet that is formed into a desired mushroom shape by deep-drawing and stamping.

DETAILED DESCRIPTION

Figure 1:
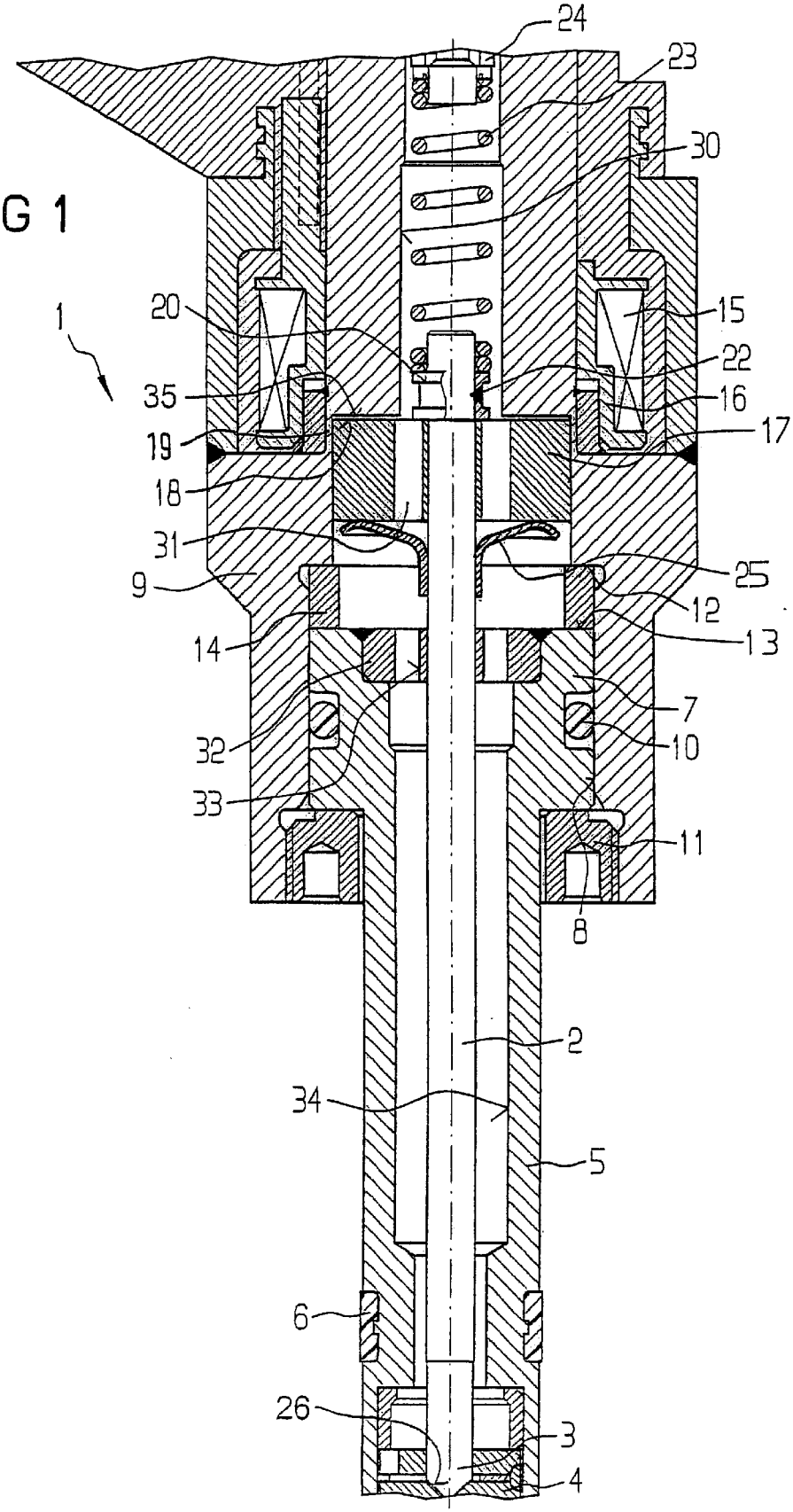
FIG. 1 shows a cross-sectional representation of one embodiment of a fuel injector valve according to the present invention.

FIG. 1 shows a cross-sectional view of a section of a fuel injector valve 1 according to the present invention. Fuel injector valve 1 is used to inject fuel in a mixture-compressing internal combustion engine with externally supplied ignition. The illustrated embodiment can be used as a high-pressure injection valve for the direct injection of fuel, in particular, gasoline, into the combustion chamber of the internal combustion engine.

Fuel injector valve 1 has a valve closing member 3, which, in the embodiment, forms one piece with a valve needle 2 and interacts with a valve seat surface provided on a valve seat body 4, forming a sealed seat. Valve seat body 4 is mounted in a tubular valve seat carrier 5, which can slide into a receiving hole in a cylinder head of the internal combustion engine and is sealed by a seal 6. Intake end 7 of valve seat carrier 5 is inserted into a longitudinal hole 8 of a housing body 9 and sealed against housing body 9 by a gasket 10. End 7 of valve seat carrier 5 is preloaded by a threaded ring 11, with a lift adjustment wheel 14 being clamped between a step 12 of housing body 9 and an upper end face 13 of valve seat carrier 5.

A magnetic coil 15 that is wound onto a coil insulating frame 16 is used for the electromagnetic operation of fuel injector valve 1. Upon the electrical excitation of magnetic coil 15, an armature 17 is drawn against a stop surface 18 of housing body 9, with housing body 9 being designed, upstream from stop surface 18, as a magnetic internal pole to which a thin-walled magnetic throttle element 19, extending from stop surface 18 in the downstream direction, is connected. Due to the fact that upstream end face 35 of armature 17 rests against a stop member 20 that forms a first stop, armature 17 carries valve needle 2 permanently connected to stop member 20 and valve closing member 3 along with it during its lifting movement. Valve needle 2 is connected to stop member 20 by a welded seam 22, for example. Valve needle 2 moves against a restoring spring 23, which is provided between an adjusting sleeve 24 and stop member 20.

The fuel flows through an axial bore hole 30 in housing body 9 and through at least one axial bore hole 31 provided in armature 17 as well as through axial bore holes 33 provided in a guide disk 32 into a longitudinal opening 34 in valve seat carrier 5 and all the way to the sealed seat of fuel injector valve 1.

Armature 17 is positioned so that it can move on valve needle 2 between stop member 20 and a spring element 25 designed as a sliding spring and damping spring and serving as a second stop. In the non-excited rest position, armature 17 is held in position against stop member 20 by the spring force of spring element 25. Spring element 25 is permanently connected to valve needle 2.

The clearance of armature 17 provided between stop member 20 and spring element 25 isolates the inert masses of armature 17 from valve needle 2 and valve closing member 3 on the other. As valve needle 2 closes, only the inert mass of valve needle 2 is therefore applied to a valve seat surface 26 of valve seat body 4. Armature 17 is not abruptly decelerated when valve closing member 3 strikes valve seat surface 26, but instead moves against spring element 25, which brakes the movement of armature 17. Spring element 25 dampens the impact of armature 17 as it strikes the second armature stop that is facing stop member 20 and, according to the present invention, is spring element 25 itself.

Figure 2:
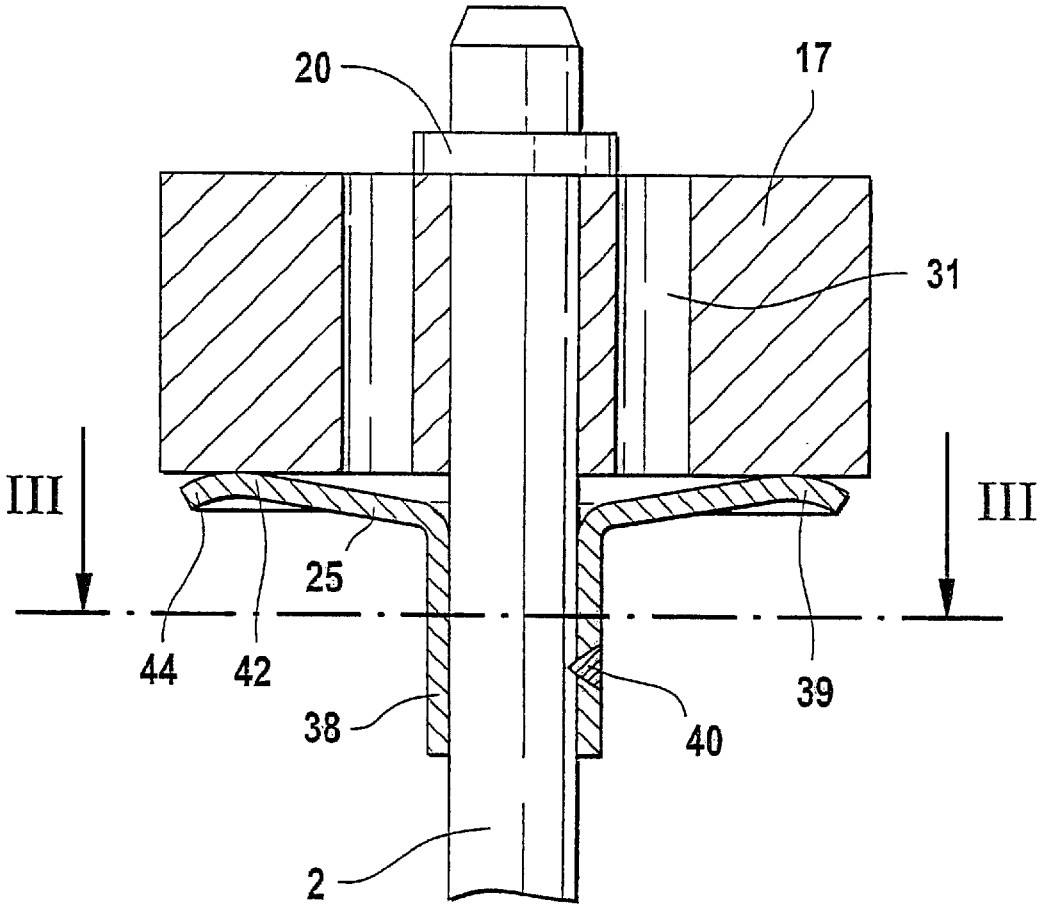
FIG. 2 shows an enlarged detail of a section around the armature illustrated in FIG. 1.

FIG. 2 shows the section according to the present invention around armature 17 on a different scale. The position of axially moving armature 17 between its two stops is made especially clear, with stop member 20 having a simpler design than the one shown in FIG. 1. Spring element 25 is used firstly as the lower stop for armature 17; secondly as a damping element that continuously brakes the movement of armature 17 and this prevents or greatly limits the bouncing action of valve needle 2 against valve seat surface 26; and thirdly as a sliding spring that presses armature 17 into position against stop member 20 in its rest position. A high degree of functional integration is advantageously achieved with just one component.

Figure 3:
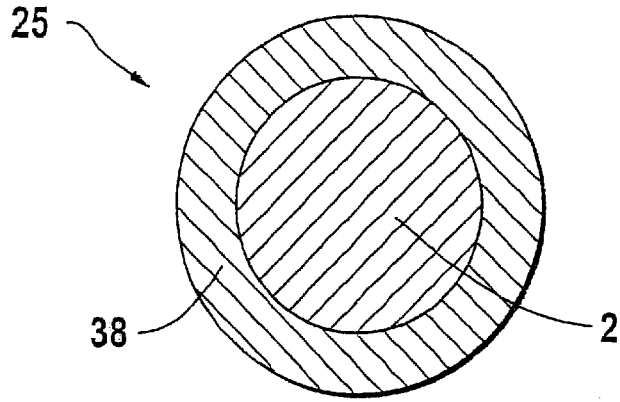
FIG. 3 shows a cross-section along line III—III in FIG. 2.
Figure 4:
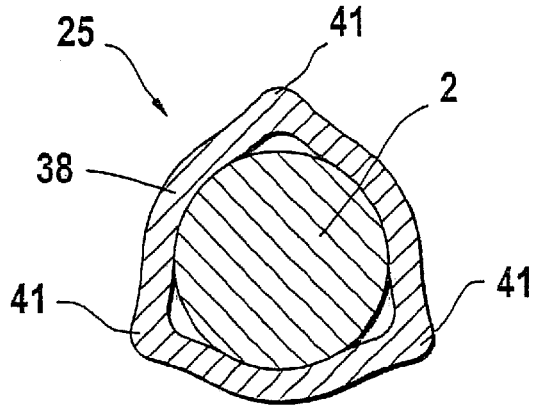
FIG. 4 shows an alternative embodiment, similar to the representation in FIG. 3, of the spring element serving as a damping spring.

Spring element 25 is advantageously designed with a tubular shank 38 and multiple spring arms 39 extending outward from it. Shank 38 of spring element 25 directly engages with valve needle 2 and rests against the latter. Two different embodiments of shank 38 are conceivable, as shown in FIGS. 3 and 4, which illustrate cross-sections along line III—III in FIG. 2. In the embodiment illustrated in FIG. 3, sleeve-shaped shank 38 rests directly against valve needle 2, which has a circular cross-section, and completely surrounds the latter. Shank 38 according to FIG. 4, on the other hand, is designed, for example, with three axially arranged ribs 41 that are spaced at a distance of 120° and project outward from valve needle 2. These axial ribs 41 increase the radial elasticity of spring element 25 and allow greater tolerances for the tight fit needed to produce a permanent connection on valve needle 2. This also produces a large engagement surface, allowing spring element 25 to slide along valve needle 2 in an axial direction, in order to mount and adjust spring element 25.

In addition to the above-mentioned embodiment in which valve needle 2 and spring element 25 are paired and have a tight fit to form a permanent, tight connection, it is also possible to ensure a stronger connection in the area of shank 38 by setting one or more weld points or seams 40, as indicated on the right side of FIG. 2. Spring element 25, which is made, for example, of a stainless spring steel sheet, is formed into the desired shape, for example, by deep-drawing and subsequent stamping. The actual spring action is generated by spring arms 39, which extend outward from shank 38 and are supported by valve needle 2. Spring arms 39 extend outward like fingers across the entire circumference of shank 38, with each individual spring arm 39 being arched under a spring tension. As shown in FIG. 2, spring arms 39 are arched in such a way that the edge region of armature 17 comes to rest on spring arms 39 at outer areas 42 near the outer circumference, preventing armature 17 from tilting. Behind outer areas 42 serving as a support surface for the armature, the radial ends of spring arms 39 form spring arm ends 44, which again bend away from armature 17 so that no sharp edges rest against armature 17.

Figure 5:
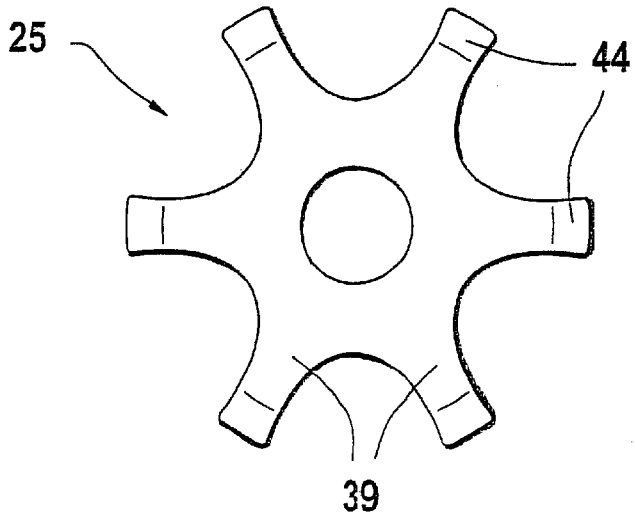
FIG. 5 shows a top view of a spring element.

FIG. 5 shows a top view of a spring element 25 having six spring arms 39 distributed over the circumference. However, it is equally conceivable for spring element 25 to have a different number of spring arms 39. For example, spring arms 39 are narrower in the outward radial direction than they are in the direction of shank 38 according to the variation in the flexural torque.

What is claimed is:

1. A fuel injector valve for a fuel injection system of an internal combustion engine, comprising:

a magnetic coil;

an armature to which the magnetic coil applies a force in a lifting direction;

a valve closing member;

a valve needle connected to the valve closing member;

a first stop connected to the valve needle and limiting a movement of the armature in the lifting direction; and a second stop connected to the valve needle and limiting the movement of the armature against the lifting direction, wherein:

the armature is moveable between the first stop and the second stop, and the second stop includes a sliding spring element.

2. The fuel injector valve according to claim 1, wherein:

the spring element is pressed onto the valve needle.

3. The fuel injector valve according to claim 2, wherein:

the spring element is additionally secured on the valve needle by one of at least one weld point and at least one weld seam.

4. The fuel injector valve according to claim 1, wherein the spring element includes:

a shank surrounding the valve needle, and multiple spring arms extending outward from the shank.

5. The fuel injector valve according to claim 4, wherein:

the shank includes a plurality of axial ribs that extend outward from the valve needle and that are distributed over a circumference of the shank.

6. The fuel injector valve according to claim 4, wherein:

the multiple spring arms are arched under a spring tension.

7. The fuel injector valve according to claim 4, wherein:

an edge region of the armature rests on the multiple spring arms at outer areas located at a distance from the valve needle near an outer circumference.

8. The fuel injector valve according to claim 1, wherein:

the spring element is produced from a spring steel sheet in accordance with a deep-drawing operation and a stamping operation.

* * * * *